United States Patent [19]

Fukuroi et al.

[11] 4,206,619

[45] Jun. 10, 1980

[54] DYEING APPARATUS

[75] Inventors: Akio Fukuroi, Uozu; Masanobu Hayashi, Kurobe; Hiroshi Yamashita, Nagoya; Isao Sugimoto, Aichi, all of Japan

[73] Assignees: Yoshida Kokyo K.K.; Nippon Dyeing Machine Manufacturing Co. Ltd., both of Aichi, Japan

[21] Appl. No.: 40,978

[22] Filed: May 21, 1979

[30] Foreign Application Priority Data

May 30, 1978 [JP] Japan ..... 53-63804

[51] Int. Cl.[2] ..... D06B 5/18

[52] U.S. Cl. ..... 68/20; 68/189

[58] Field of Search ..... 68/20, 189, 150

[56] References Cited

U.S. PATENT DOCUMENTS 3,685,324 8/1972 Vorderbruegge et al. ..... 68/150

FOREIGN PATENT DOCUMENTS 2525871 12/1976 Fed. Rep. of Germany ..... 68/189
2258902 8/1975 France ..... 68/189
551970 11/1956 Italy ..... 68/189
837218 6/1960 United Kingdom ..... 68/189

*Primary Examiner*—Philip R. Coe
*Attorney, Agent, or Firm*—Bucknam and Archer

[57] ABSTRACT

A dyeing apparatus is disclosed which has a cylindrical vessel and a perforated hollow beam supported therein. Textile materials such as yarns, tapes and the like are wound upon the exterior of the beam and soaked to depth with treatment liquid forced radially through the perforations of the beam into the layers of wound-up material. Liquid is withdrawn from the vessel for re-circulation through a first take-out means provided adjacent the upper portion of the vessel and through a second take-out means provided centrally of the bottom portion of the vessel. Control means is provided to regulate the flow of liquid through the two take-out means to be in a specified ratio.

3 Claims, 4 Drawing Figures

DYEING APPARATUS

BACKGROUND OF THE INVENTION

1. Field of the Invention

This invention relates to apparatus for dyeing or otherwise treating textile materials.

More specifically, the invention is directed to dyeing apparatus employing a perforated cylindrical beam for winding thereon materials to be treated and further including means dewatering or demoisturing the treated materials.

2. Prior Art

There are known a number of dyeing apparatus designed for forcing treatment liquids such as dyeing, bleaching and other media into and through textile materials such as yarns, tapes and other fabrics that are wound on a perforated cylinder commonly known as "beam". The treatment liquid is forced under pressure to penetrate the layers of material radially from inside of the beam on which the material is wound or wrapped. Difficulty has been experienced with many of the prior art apparatus in securing uniformity of treatment in all portions of the material often resulting in different shades or hues both radially and axially of the roll of material.

To eliminate such treatment defects, it has been proposed as disclosed for example in U.S. Pat. No. 3,685,324 to rotate the beam during treatment of the material thereon. Such devices are however disadvantageous in that complicated mechanical arrangements and high power consumption are required.

SUMMARY OF THE INVENTION

It is therefore the primary object of the present invention to provide an improved beam-dyeing apparatus which incorporates structural features tailored to attain uniformity and repidness of treatment of textile materials.

A more specific object of the invention is the provision of means in a beam-dyeing apparatus of maintaining uniform distribution and penetration of treatment liquids in both the radial and the axial direction of the beam on which the material to be treated is wound.

According to the invention, there is provided a dyeing apparatus which comprises a cylindrical vessel of generally circular cross-section extending longitudinally along a generally horizontal axis and having a removable dished end; a perforated hollow beam supported within said vessel and extending longitudinally along said horizontal axis and adapted to wind upon its exterior a material to be treated; anular rim members secured to and extended transversely around said beam at opposite ends thereof and defining therebetween an annular volumetric section for retaining the material; a perforated flow-rectifying panel extending longitudinally of the vessel and overlying the upper portion of said beam; means supplying and circulating treatment liquid through the vessel; a first liquid flow take-out means mounted on the exterior of the vessel adjacent the front end thereof and passing liquid from the upper portion of the vessel to said supplying and circulating means; a second liquid flow take-out means positioned substantially centrally of the vessel and passing liquid from the bottom portion of the vessel to said circulating means; and means controlling the amount of liquid take-out from the vessel through said first and second take-out means.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
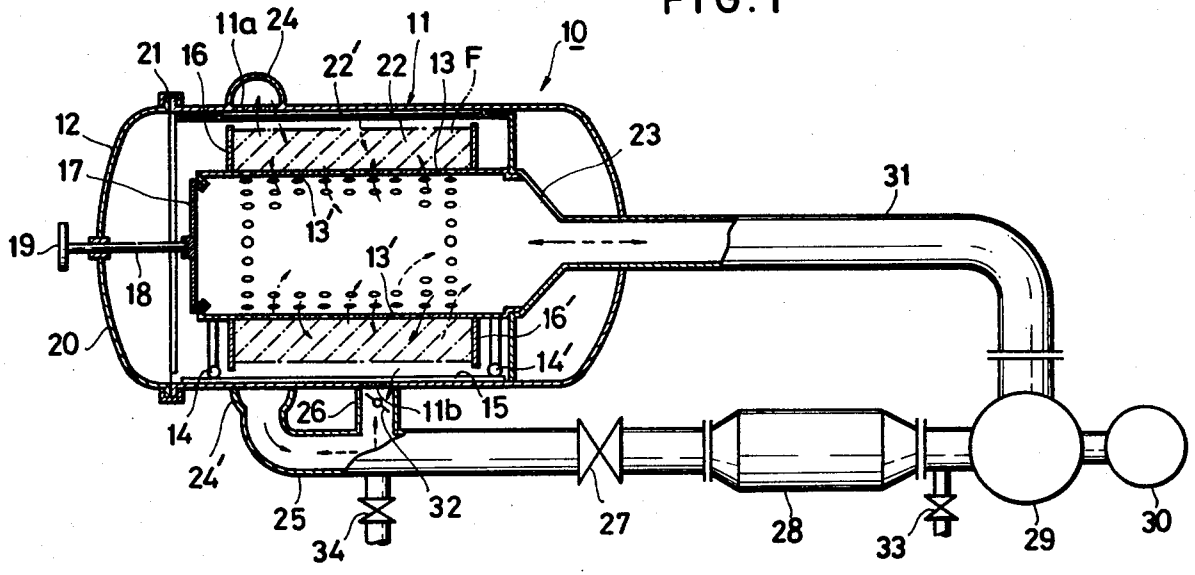
FIG. 1 is a longitudinal cross-sectional, partly schematic, view of a beam-dyeing apparatus provided in accordance with the invention.

Referring now to the drawings and FIG. 1 in particular, there is shown a dyeing apparatus 10 having a cylindrical vessel 11 of generally circular transverse cross-section and extending longitudinally along the generally horizontal axis. The vessel 11 has dished ends, one of which designated at 12 is removable for purposes hereafter noted. A perforated hollow beam 13 is supported within the vessel 11 and extending along the horizontal axis thereof. The beam 13 is capable to support material F to be dyed, which material is wound upon the exterior of the beam 12 in the manner of a bobbin. The beam 13 has a multiplicity of perforations 13' formed in and distributed uniformly around the periphery of the beam 13 to allow dye liquid to flow into and through the material F.

The beam 13 has a pair of rollers 14,14' at its opposite ends which are movably mounted on a rail 15 secured to and extending longitudinally of the vessel 11.

A pair of annular rim members or spacers 16,16' are secured to and extended transversely around the beam 13 at opposite ends thereof. The rim members 16,16' define therebetween an annular volumetric section in which the material or fabric F wound on the beam 13 is confined and retained in place.

A lid or cover 17 is provided which is centrally engageable with a rod 18 connected to a handle 19. Rotating this handle in one direction clamps the lid 17 to seal the front end of the beam 13 and in the opposite direction releases the lid 17 to permit removal of the beam 13 when a cycle of dyeing operation has been completed.

A cap 20, which forms the front dished end 12 of the vessel, is threadedly engaged with the handle rod 18 and removably connected to the vessel 11 by suitable means such as a clamping ring 21.

A perforated, flow-rectifying panel 22 is provided within the vessel 11 in a position overlying the upper portion of the beam 13. The panel 22 which extends longitudinally of the vessel 11 has a perforated center portion 22' disposed in coextensive relation with the perforated wall of the beam 13, with one end of the panel 22 secured to the inner wall of the vessel 11 and the other end to the terminal end of a flared conduit connector 23. The other or rear end of the beam 13 is removably fitted circumferentially to the flared portion of the conduit connector 23.

There is provided a first liquid flow take-out means which is in the form of an annular jacket 24 mounted on the exterior of the vessel 11 adjacent the front end of the vessel 11. The jacket 24 has a bottom portion 24' coextensive with and opening into a liquid flow conduit 25.

The upper portion 11*a* of the vessel 11 which registers with the jacket 24 is perforated to establish liquid communication between the beam 13, the jacket 24 and the flow conduit 25.

A second liquid flow take-out means in the form of a pipe 26 is connected to the bottom of the vessel 11 and ties into the flow conduit 25 and located substantially centrally of the vessel 11. The bottom portion 11*b* of the vessel which registers with the flow take-out pipe 26 is also perforated so as to establish liquid communication between the beam 13, the pipe 26 and the conduit 25.

The conduit 25 for withdrawing dye liquid from the vessel 11 is connected via valve 27 to a heat exchanger 28 whereby dye or treatment liquid is maintained at a predetermined temperature. A pump 29, preferably of a reversible function, driven by a motor 30 is connected at its suction side to the heat exchanger 28 and at its discharge side to the flared connector 23 via conduit 31.

In the operation of the apparatus thus constructed, dye liquid is supplied from a source not shown through valve 33 and distributed by pump 29 through conduit 31 and through the flared connector 23 whereupon the liquid is introduced into the interior of the beam 13. The liquid is then forced radially outward through the perforated beam 13 and into the layers of fabric F wound thereon, and after soaking fabric F to depth, is withdrawn out of the vessel 11. In such instance, a portion of the liquid is passed upwardly through the flow-rectifying panel 22 and through the upper perforated wall 11*a* into the first flow take-out means, namely, jacket 24, thence into conduit 25. The remaining portion of the liquid is passed downwardly through the bottom perforated wall 11*b* and through the second flow take-out means, namely pipe 26 into common conduit 25. Designated at 34 is an outlet valve for draining used treatment liquid.

It has now been found that uniform and efficient treatment of the material F can be achieved by regulating the flow rate of liquid through the second flow take-out means 26 to be preferably in the range of one-third ($\frac{1}{3}$) to four-fifth (4/5) of the flow through the first flow take-out means 24. As a practical expediency, there is provided in the liquid passage of the flow take-out pipe 26 a control valve 32 whereby the rate of withdrawal of liquid from the vessel can be controlled in the above preferred range.

Figure 2:
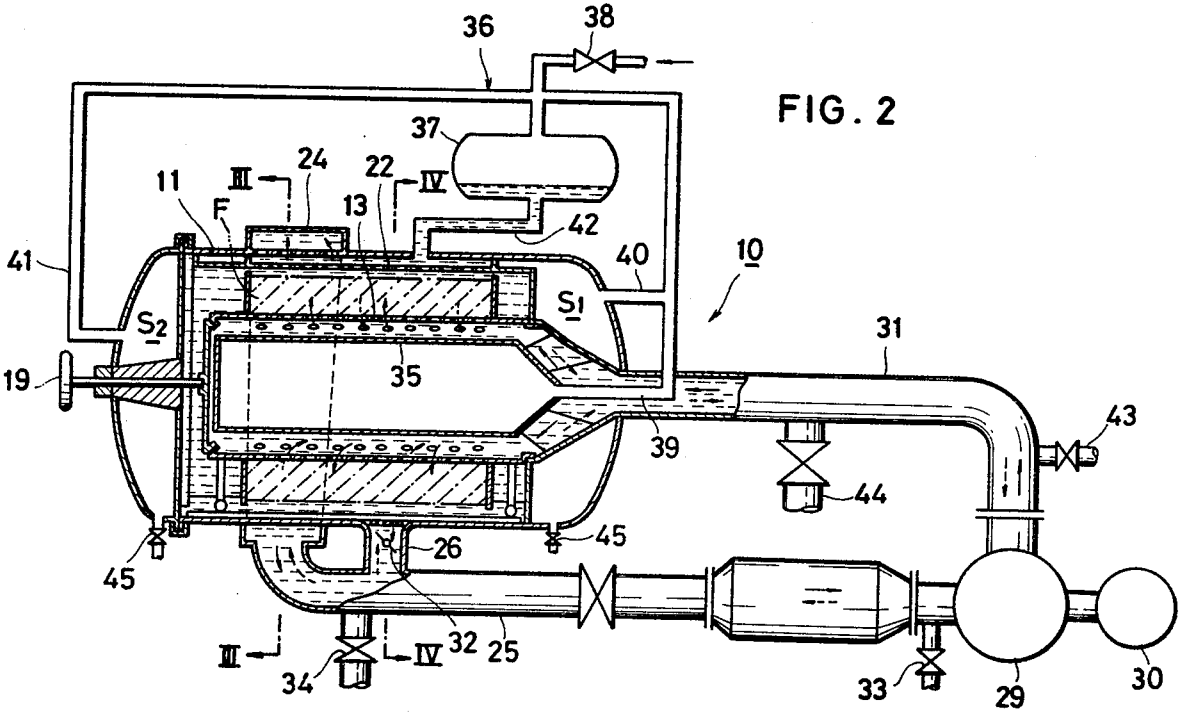
FIG. 2 is a longitudinal cross-sectional, partly schematic, view of another beam-dyeing apparatus according to the invention which is capable of performing the dyeing operation at once and subsequent dewatering or demoisturing operation.
Figure 3:
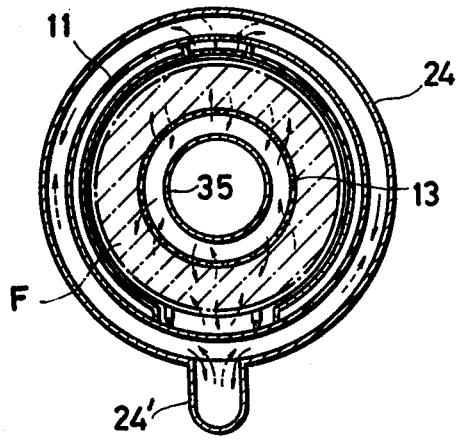
FIG. 3 is a transverse cross-sectional view taken on the line III—III of FIG. 2.
Figure 4:
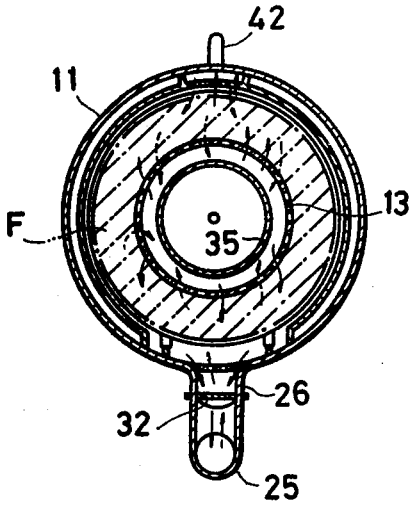
FIG. 4 is a transverse cross-sectional view taken on the line IV—IV of FIG. 2.

Referring now to FIGS. 2–4, inclusive, there is shown another form of apparatus according to the invention which is basically the same as the apparatus shown in FIG. 1 in so far as concerns the principles of the invention. Hence, all parts of the apparatus which are common and identical are indicated by the same reference numerals, and the following description will deal with only those apparatus parts which are added.

Designated at 35 is an elongated non-perforated dummy cylinder adapted primarily to reduce the volume within the vessel 11 which must be supplied with treatment liquid. The dummy cylinder 35 is positioned within the hollow portion of the beam 13 to define therewith an annular flow passage for the dye liquid.

For dewatering or demoisturing the material F which has been treated, there is provided means generally designated 36 which stores and supplies compressed air to the interior of the vessel 11. The means 36 comprises an air tank 37 installed outside of the vessel 11 for storing compressed air supplied from a suitable source (not shown) via valve 38. To the tank 37 are connected a first piping 39 leading to and communication with the interior of the dummy cylinder 35, a second piping 40 leading to and communicating with the space $S_1$ at the rear end of the vessel 11 and a third piping 41 leading to and communicating with the space $S_2$ at the front end of the vessel 11, the arrangement being that a closed circuit is formed for normally maintaining an equalized air pressure therethrough.

A fourth piping 42 is connected at one end to the bottom of the tank 37 and opens at the other end into the vessel 11 at a position overlying the perforated panel 22 for supplying compressed air into the vessel 11 during dewatering of the treated material F.

It will be noted that the above air-store-and supply means 36 serves to establish pressure equalizing communication between a given interior region of the vessel and the hollow portion of the dummy cylinder 35 thereby reducing the structural loading upon the apparatus 10 as a whole.

Designated at 43 is a treatment liquid supply valve and at 44 is a drainage valve. The operation of dewatering or demoisturing treated fabric F is disclosed in the copending U.S. application Ser. No. 957,181 and will require no further description as this part of the disclosure does not constitute positive features of the invention. Designated at 45 are steam traps.

It will be noted that the liquid flow take-out means 24 and 26 provided commonly in the two forms of apparatus above described are located at the respective specified positions and the flow of liquid therethrough is controlled to be in the range of $\frac{1}{3}$ to 4/5 such that uniform and sufficient treatment of the material F can be achieved.

If necessary, the operation of the pump 29 may be reversed so that the direction of flow of treatment liquid is changed.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A dyeing apparatus which comprises a cylindrical vessel of generally circular cross-section extending longitudinally along a generally horizontal axis and having a removable dished end; a perforated hollow beam supported within said vessel and extending longitudinally along said horizontal axis and adapted to wind upon its exterior a material to be treated; annular rim members secured to and extended transversely around said beam at opposite ends thereof and defining therebetween an annular volumetric section for retaining the material; a perforated flow-rectifying panel extending longitudinally of the vessel and overlying the upper portion of said beam; means supplying and circulating treatment liquid through the vessel; a first liquid flow take-out means mounted on the exterior of the vessel adjacent the front end thereof and passing liquid from the upper portion of the vessel to said supplying and circulating means; a second liquid flow take-out means positioned substantially centrally of the vessel and passing liquid from the bottom portion of the vessel to said circulating means; and means controlling the amount of liquid take-out from the vessel through said first and second take-out means.

2. Apparatus according to claim 1 wherein said controlling means is a control valve controlling the rate of liquid flow from said second take-out means to be in the range of one-third to four-fifth of the rate of flow from said first take-out means.

3. Apparatus according to claim 1, further including an elongated non-perforated dummy cylinder positioned within the hollow portion of said beam to define therewith an annular flow passage for treatment liquid, and means supplying compressed air to the vessel, said means serving to establish pressure equalizing communication between the hollow portion of said dummy cylinder and a given interior region of the vessel.

* * * * *